US008381333B2

(12) United States Patent
Friedman

(10) Patent No.: US 8,381,333 B2
(45) Date of Patent: Feb. 26, 2013

(54) MATTRESS SUPPORTED CO-SLEEPING BABY BEDSIDE METHODS AND APPARATUS

(76) Inventor: Steven Friedman, Greeley, CO (US)

( * ) Notice: Subject to any disclaimer, the term of this patent is extended or adjusted under 35 U.S.C. 154(b) by 18 days.

(21) Appl. No.: 13/074,587

(22) Filed: Mar. 29, 2011

(65) Prior Publication Data

US 2012/0246824 A1 Oct. 4, 2012

(51) Int. Cl.
*A47D 7/00* (2006.01)

(52) U.S. Cl. ..... 5/95; 5/96; 5/691; 5/655; 5/658; 5/659

(58) Field of Classification Search ..... 5/95, 96, 5/691, 655, 658, 659
See application file for complete search history.

(56) References Cited

U.S. PATENT DOCUMENTS

| | | | | |
|---|---|---|---|---|
| 447,167 | A * | 2/1891 | Smith | 5/95 |
| 961,669 | A * | 6/1910 | Atkinson | 5/95 |
| 5,148,561 | A * | 9/1992 | Tharalson et al. | 5/95 |
| 5,161,484 | A | 11/1992 | Duane | |
| 5,165,130 | A | 11/1992 | Wendling | |
| 5,172,435 | A * | 12/1992 | Griffin et al. | 5/95 |
| 5,509,373 | A | 4/1996 | Elesh | |
| 5,642,541 | A | 7/1997 | Corbin | |
| 5,819,340 | A | 10/1998 | Kelly | |
| 6,202,228 | B1 * | 3/2001 | Cox | 5/95 |
| 6,536,057 | B2 | 3/2003 | Fennell et al. | |
| 6,546,575 | B2 | 4/2003 | DeAngelo | |
| 6,550,082 | B2 | 4/2003 | Tharalson et al. | |
| 6,554,691 | B1 | 4/2003 | Schauls | |
| 6,862,757 | B2 | 3/2005 | Andriunas et al. | |
| 7,013,505 | B2 | 3/2006 | Martin | |
| RE39,136 | E | 6/2006 | Tharalson et al. | |
| 7,086,101 | B2 | 8/2006 | Welch et al. | |
| 7,415,739 | B2 | 8/2008 | Tharalson et al. | |
| 2003/0037372 | A1 | 2/2003 | Andriunas et al. | |
| 2003/0037378 | A1 | 2/2003 | Wu | |
| 2003/0131409 | A1 * | 7/2003 | DeAngelo | 5/95 |
| 2007/0006808 | A1 | 1/2007 | Scatchard et al. | |
| 2009/0050764 | A1 | 2/2009 | Yankovec et al. | |

* cited by examiner

*Primary Examiner* — William Kelleher
(74) *Attorney, Agent, or Firm* — Santangelo Law Offices, P.C.

(57) ABSTRACT

To accommodate safe, convenient, and effective sleeping arrangements perhaps with mothers and babies, the present invention entails a co-sleeping apparatus and methods having a simple support which may be affixed by friction in a bed and uses a cantilever design to support various forms of baby, pet, and doll baskets (or other sleeping receptacles of choice) at close proximity and convenient locations near a resting parent. This simple cantilever design may provide three important advantages: an immediate arms' reach access to an infant without ever having to leave a bed; interference free design perhaps with no floor supports or bulky stands; and an extremely simple method for single-handed mounting, adjusting, and dismounting of an infant, pet, and doll sleeping receptacle and the like. Embodiments may provide stowing the apparatus in a virtually disappearing condition and the apparatus may be easily disassembled or even folded linearly for convenient long term storage.

20 Claims, 9 Drawing Sheets

MATTRESS SUPPORTED CO-SLEEPING BABY BEDSIDE METHODS AND APPARATUS

BACKGROUND OF THE INVENTION

With the ever growing scientific, medical, and psychological research and subsequent consensus that breastfeeding and co-sleeping may be the most effective methods of providing both nourishment as well as security and parental bonding for infants, the need continues to grow for a method and design which can allow a simple, safe, convenient, and cost effective device to accommodate and encourage this natural mothering arrangement. A huge gap exists between all the various methods/devices presently on the market and one that is not only easily manufactured, yet meets all the other genuine requisites to encourage and facilitate a simple and extremely convenient co-sleeping process. Past attempts have been shown in U.S. Pat. No. 5,148,561 to Tharalson et al., U.S. Pat. No. 5,172,435 to Griffin et al., U.S. Pat. No. 5,819,340 to Kelly, U.S. Pat. No. 6,546,575 to DeAngelo, U.S. Pat. No. 6,550,082 to Tharalson et al., U.S. Pat. No. 6,862,757 to Andriunas et al., US Pub. No. US2007/0006808 to Scatchard et al., U.S. Pat. No. 7,013,505 to Martin, and U.S. Pat. No. 7,415,739 to Tharalson et al., each hereby incorporated by reference herein. The needed method/device should first and foremost provide a safe environment for the sleeping infant, alleviating many of the most common pitfalls, whether based on fact or myth, of accidental parental harm. Immediately after that, a device, should be both functional and convenient. This convenience should be met at all times and during all stages of use, beginning at initial assembly, definitely during use, and perhaps even extending all the way through storage concerns, which may constitute times between as well as after both short term and long term (e.g., between siblings or even generations of offspring) intervals. Key factors of this convenience may include mother/infant proximity, user friendly operations, and even simple and efficient storage.

Benefits to co-sleeping and breastfeeding include not only exceptional nutritional, immunologic, psychological, social, and emotional development for an infant, but overall physical, psychological, economic, environmental, and emotional benefits for the mother as well. Physically, the benefits may facilitate an earlier return to normal sleep patterns and pre-pregnancy weight for the mother. Psychologically, they may relieve a mother of separation anxiety caused by various newborn safety risks. Economically and environmentally, they may be the most efficient and natural forms of feeding any baby. And emotionally, they may help reduce the severity or chance of postpartum anxiety issues. Together, studies show that an infant in close proximity to its mother may regulate heartbeat and perhaps even breathing more effectively, possibly reducing the risk of SIDS. From what we know from scientific research alone about the health benefits received by an infant nourished by breast milk vs. artificial formulas, this form of natural mothering is by far the healthiest arrangement.

Overall safety may be of utmost importance when using any product used in connection with a newborn. Most products on the market may include complicated and unreliable collapsible hinges, clips, and perhaps even latches. Vast amounts of government regulation effort is spent on many of these product recalls, with replacement costs, liability costs, and environmental waste caused by both consumer product replacement manufacturing and even disposal issues being astronomical. None of the past basket stands provide adequate tipping stability while being utilized where pets and other young children might be present.

Nothing could be of closer and accessible proximity as directly beside a nursing mother at or close to the same vertical level as her own sleeping platform. For daytime napping, the parent's bedroom may generally be the most secluded and quiet environment in the house. While in the past, a bassinet style stand or a Moses basket used with a basket stand combination may allow a co-sleeper proximate to a bedside; however one of the main problems that plagues these types of methods/devices may be their inability to match the elevation height to convenient levels relative to the nursing mother's varying mattress thickness and subsequent bed heights. While trying to circumvent this design problem, they may require the purchase of additional expensive, unreliable, and perhaps even clumsy stand leg extensions. Still other devices in the past, such as those discussed in U.S. Pat. No. 5,165,130 to Wendling, U.S. Pat. No. 6,536,057 to Fennell et al., and U.S. Pat. No. 7,086,101 to Welch et al., each hereby incorporated by reference herein, may provide a wonderful co-sleeping arrangement directly on the parent's bed while still protecting the infant. Though very safe and close, these devices may not allow a disturbance barrier for either the infant or the adults. Throughout the night, movement from an adult transitioning into or out of bed as well as simply repositioning once in bed, can cause enough movement to disturb a sleeping infant. The same goes for a repositioning infant near light sleeping adults. Both disturbance and health issues may be relevant to owners of pets who desire to co-sleep with them for security and bonding reasons as well. Recent studies warn pet owners about the adverse health risks of sharing such intimate sleeping arrangements with an animal.

Initial assembly and disassembly of any device should be simple and easily accomplished perhaps by any adult even using simple tools. Single handed operation should be possible during all facets of use, since most mothers may be holding an infant or sleeping receptacle or both with one or even both hands. Having the ability for an eager child to help with everyday use and intermediate storage could also be a benefit. The past devices may not provide these features.

Lastly, past attempts at co-sleeping arrangements may constantly take up space, perhaps both during use, between everyday use, between intervals of babies, and even long term intervals such as between generations of offspring. During use, many past devices may take up sometimes valuable floor space in high traffic areas around a confined bedroom. Even when not being used, the past devices may continue to take up the same space even though physically moveable to another area of the room or house. Either way, they constantly remain in view, being both a physical as well as aesthetic nuisance. After an infant may be old enough to transition to a full sized crib or even into its own room, devices in the past may need to be either disassembled or stored in their bulky configuration until the need arises for use with perhaps another child. Many times, this moving, disassembly, and storage may result in damage and wear to the past products, preventing them from remaining useful throughout multiple generations. It may be desirable then to provide an heirloom quality product perhaps made from solid hardwood with perhaps even literally no moving parts, yet either collapsible or easily disassembled into a very concise and damage free configuration which could be used indefinitely.

SUMMARY OF THE INVENTION

Accordingly, the present invention provides apparatus and methods for bedside support of a baby, pet, doll sleeping receptacles, or the like to both encourage and facilitate a secure, functional, accessible, simple, efficient, and even convenient co-sleeping arrangement. The functionality of providing extremely close proximity co-sleeping and perhaps even efficient breastfeeding access may only be outweighed by its convenient method of use.

An objective of the present invention may be to provide a separate yet easily accessible sleeping arrangement for a young infant, a pet, a toy doll, or the like.

Yet another object of the present invention may provide a bedside support which may be functional, and when not in use, may be easily stored perhaps even for use several times a day such as for naps and at night. This objective may be provided to accomplish a close arrangement with a space saving design. Embodiments of the invention may provide an apparatus which takes up literally no floor space perhaps even during all aspects of use and storage, and even no space between uses while temporarily stored. Once assembled, a significant aspect of embodiments of the invention may be that it has no moving parts for either wear or failure.

Another object of the present invention may include an apparatus that is a relatively planar device. It may be made from thin yet rigid members attached to a front supporting cross-brace member which may squeeze a sleeping receptacle, such as a Moses basket, up tight next to an adult sleeping mattress. Assembly may be accomplished by any capable adult perhaps using very common tools. For example, a wrench, a screwdriver, a coin, or the like may be utilized to completely assemble the apparatus and even a sleeping receptacle. The rigid thin members may be spaced appropriately to laterally secure and support the above mentioned sleeping receptacle. Their length may be adequate to allow proper cantilever strength to mount, dismount, and perhaps even permanently rest a receptacle on and may only utilize weight and friction from the mattress. A safety aspect may include providing attachable blocks perhaps mounted to a bottom of a sleeping receptacle that may allow for a securement method onto the support platform. An additional aspect of these blocks may include a curved bottom perhaps offset slightly to facilitate a subtle rocking motion while on both a flat surface as well as the support platform.

Another aspect of the present invention may be to slide a support between a mattress and mattress foundation perhaps with only a small amount of force to provide a flat platform to rest or even attach a sleeping receptacle. With one simple push from a single hand, hip, elbow, or the like, to snug up the above mentioned receptacle tight next to the adult mattress, the support may be positioned for use and may be ready for the twist of another single-handed latch to secure it in place. This aspect may be of huge importance when a mother is either holding an infant either directly or already in a sleeping receptacle and may only have one free hand to prepare a sleeping support. After nightly or even nap time use, the latch can be recessed, the apparatus can reversibly be single-handedly pulled out slightly, and the sleeping receptacle can be removed and repositioned elsewhere throughout the room or house, if so desired. Once repositioned, the apparatus can be conveniently stored temporarily out of the way between the mattress and mattress foundation by sliding fully inward with above mentioned simplicity. While not being utilized, only a small portion of the device may be visible perhaps with no portions being in the way. In fact, with the concealment of a drawn-out fitted sheet over the end of the device, the entire device may become invisible. For subsequent use, the apparatus may only need to be pulled out partially and by again applying the above mentioned simple steps.

Other objects of the present invention may include aspects that provide long term storage options that may be compact and convenient, or perhaps even storage concealed inside a bed during periods between siblings. For longer term storage, the apparatus can either be left mostly concealed inside a mattress combination, collapsed into a compact and almost linear configuration, or can be easily disassembled with a few simple hardware fasteners to store even more compactly. In meeting the goal of fulfilling consumer needs, the simplistic design of the present invention may be easily manufactured from readily available materials, such as solid hardwood, and can be packaged and shipped in a fairly concise box.

Naturally, further objects, goals and embodiments of the inventions are disclosed throughout other areas of the specification.

DESCRIPTION OF THE PREFERRED EMBODIMENTS

The present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

The present invention may include co-sleeping bedside extension systems and methods. In embodiments, a bedside support may be a combination of multiple rigid members made of any material, including but not limited to wood, metal, plastic, combinations thereof, and the like, and may be attached together by fasteners such as metal threaded fasteners to hold an object such as a sleeping receptacle or the like perhaps conveniently near and even at the appropriate height relative to beds, sleeping beds mattresses, couches, and the like.

Figure 1:
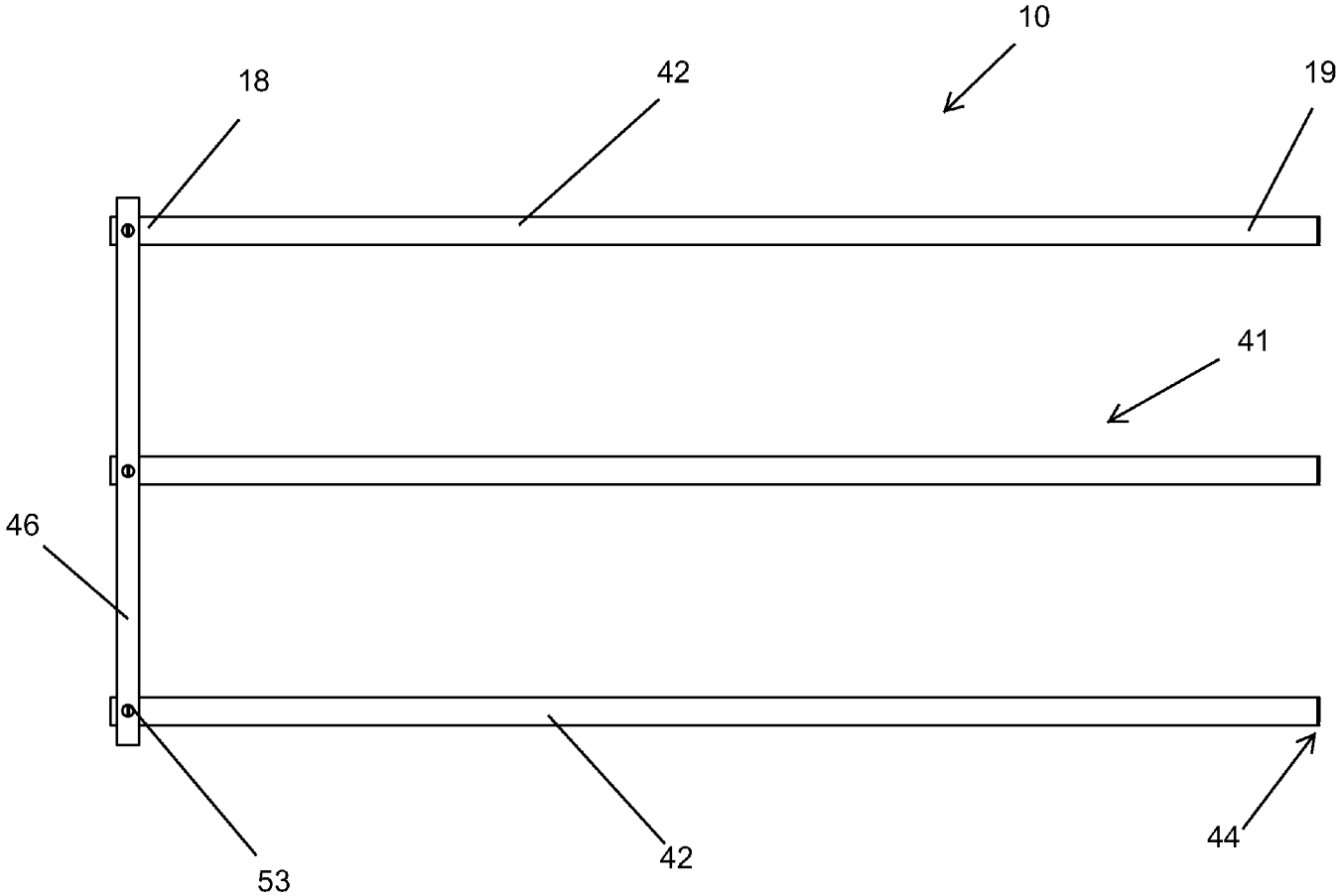
FIG. 1 is a top view of a bedside support in accordance with embodiments of the present invention.

As shown in a non-limiting example in FIG. 1, a bedside support (10) may include a rigid cross brace member (46) and at least one rigid planar member (41) which may be attached to and perhaps even planarly projecting from the rigid cross brace member (46). In FIG. 1, three rigid extension prongs (42) are shown as an example of an embodiment of a system wherein one end (18) of at least one rigid extension prong may be perpendicularly attached to a rigid cross brace member (46) and perhaps even showing the extension prongs as planarly projecting in the same direction from the cross brace member when in an open position (70). As discussed herein, this design may provide a substantially planar bedside support. It is noted that substantially planar may not be a completely flat or level support, it may have some small projections such as the rigid cross brace member (46) as understood in FIG. 2. However, any number of rigid members or even extension prongs may be provided in a bedside support and all are meant to be included in this disclosure including but not limited to one rigid planar member, at least one rigid planar member, at least two rigid extension prongs, two rigid extension prongs, at least three rigid extension prongs, three rigid extension prongs, at least four rigid extension prongs, four rigid extension prongs, or more, and the like. For example, a rigid planar member may be a single sheet, member, prong, or the like. General discussion of a rigid member, a rigid planar member, a rigid extension prong and the like as mentioned herein are all meant to be interchangeable and are meant to provide options in the various embodiments of the present invention.

Figure 3:
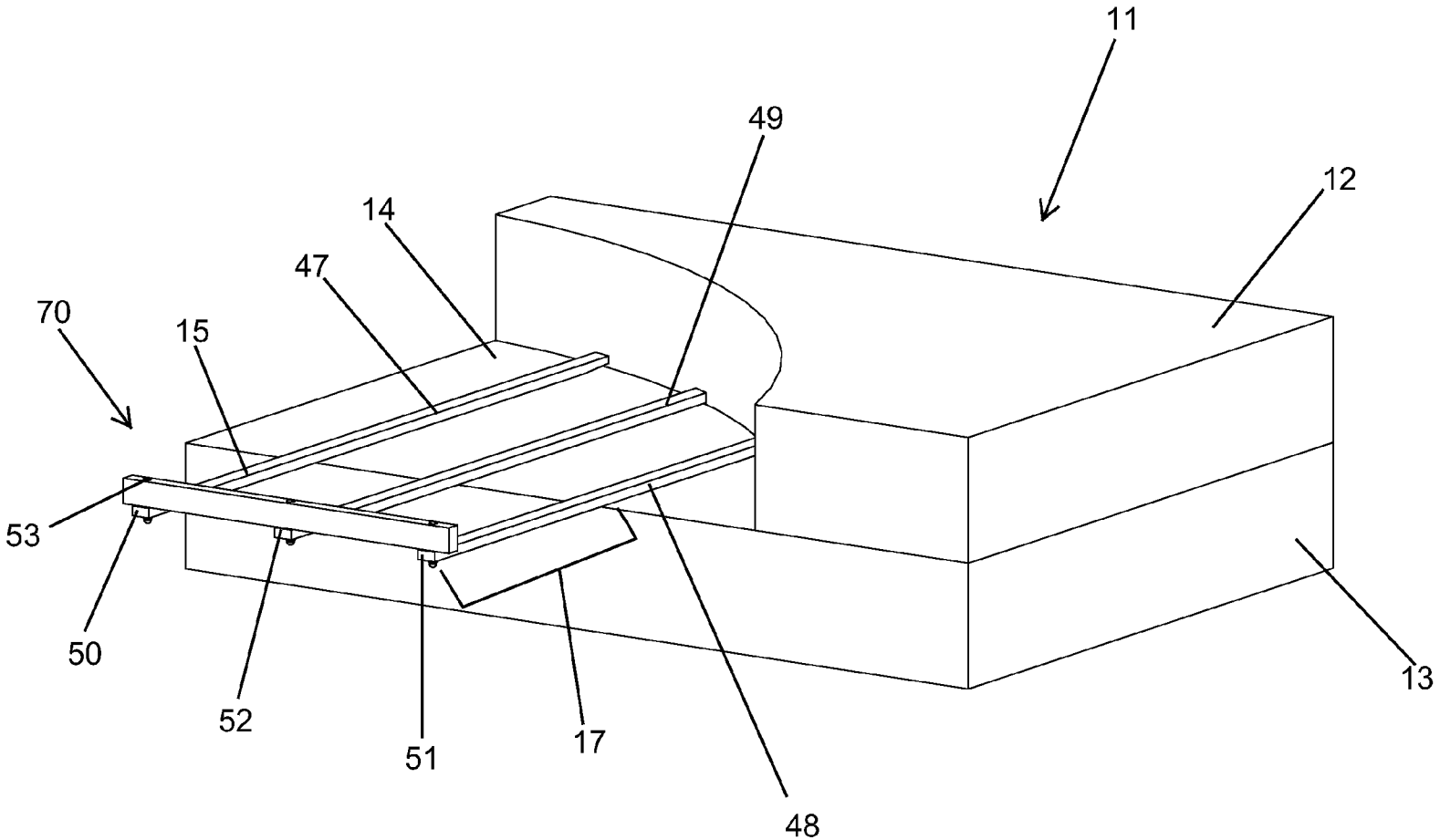
FIG. 3 shows an example of a bedside support in an open position and inserted into a bed where part of the mattress of the bed has been removed to show how the device may fit in between a mattress and mattress foundation in accordance with embodiments of the present invention.
Figure 4:
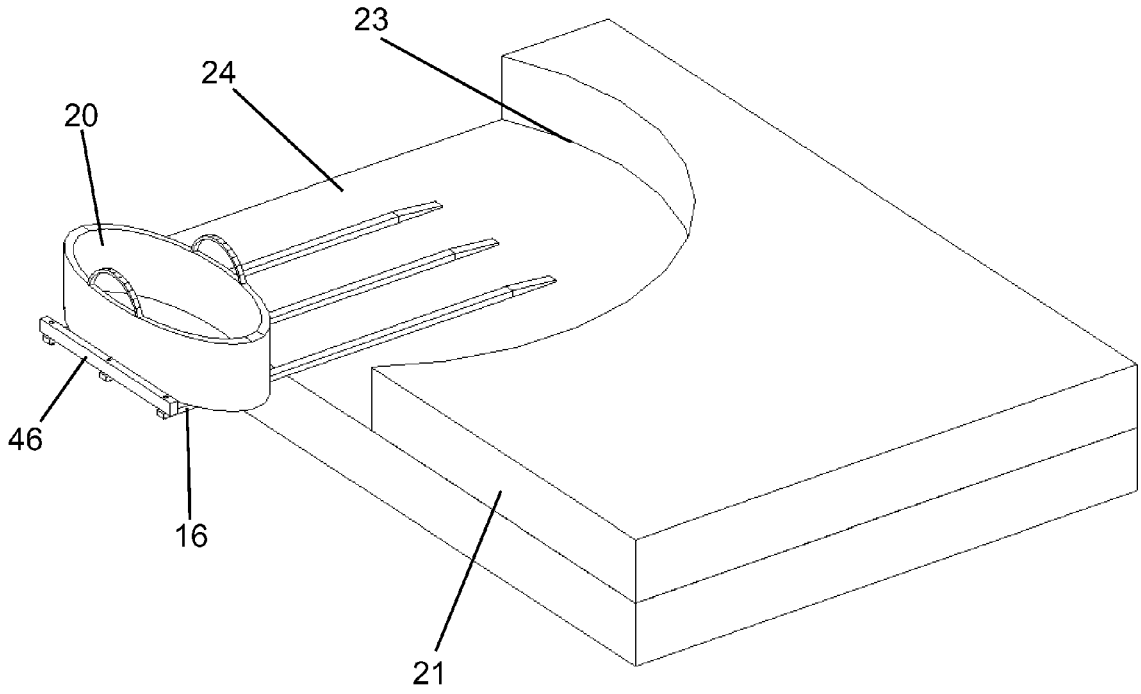
FIG. 4 shows an example of a sleeping receptacle placed on a bedside support where part of the mattress of the bed has been removed to show how the device may fit in between a mattress and mattress foundation in accordance with embodiments of the present invention.

A bedside support (10) may be installed into a bed (11) and may include a mattress displacer impingement end (44) which may be configured to slide in between a space (14) between a mattress (12) and a mattress foundation (13) as understood by the non-limiting example provided in FIG. 3. In embodiments, a mattress displacer impingement end (44) may include an unattached end (19) of a rigid planar member or even rigid extension prong(s). A bed may be any type of bed including but not limited to a twin, full, queen, king, custom, or the like beds. A mattress foundation (13) may be any kind of support for a mattress including but not limited to a box spring, mattress platform, or the like. Once installed and even inserted into a bed, part (15) of a bedside support may project or even extend out from between the mattress and the mattress foundation of the bed to perhaps provide a mattress supported, laterally projectingly suspension of part of the bedside support. The portion of the bedside support left extending out from the bed may be used to support or even be configured to securely support an object such as a sleeping receptacle (20), and may even be an extending platform sleeping receptacle receiving portion (16) of the bedside support as understood from FIG. 4. A sleeping receptacle may include but is not limited to a basket, baby bed, pet bed, Moses basket, baby basket, pet basket, doll bed, doll basket, newborn basket, or the like. The extending platform sleeping receptacle receiving portion of the bedside support may include the rigid cross brace member and at least part of the rigid planar member or extension prong(s) in the various embodiments.

As mentioned, a bedside support (10) may provide a substantially planar bedside support wherein the support and perhaps even the various parts of the bedside support may be in a planar, flat, level or the like arrangement. This may provide lateral projectingly suspending of a bedside support when installed in a bed which may include a support that may be suspended or perhaps even floating next to a side of a bed. A floating bedside support may include a bedside support which does not have any floor support. As such, embodiments of the present invention may provide contact of a bedside support (10) only between a bottom (23) of a mattress and a top (24) of a mattress foundation. It may be that this configuration of contact only between the bed may provide simplistic, easy, perhaps even efficient use of the bedside support.

In embodiments of the present invention and as specifically shown in FIG. 3, an example of using more than one extension prong in a bedside support may be provided. In this example, at least three rigid extension prongs may be equally spaced along a rigid cross brace member (46). This may include a first end extension prong (47) attached near one end (50) of the rigid cross brace member, a second end extension prong (48) attached near an opposite end (51) of the rigid cross brace member, and perhaps even a middle extension prong (49) attached near a middle (52) of the rigid cross brace member. If perhaps only two extension prongs were included, an open position of the bedside support may include a u-shape configuration of the bedside support, e.g., FIG. 1 without the middle extension prong.

Figure 2:
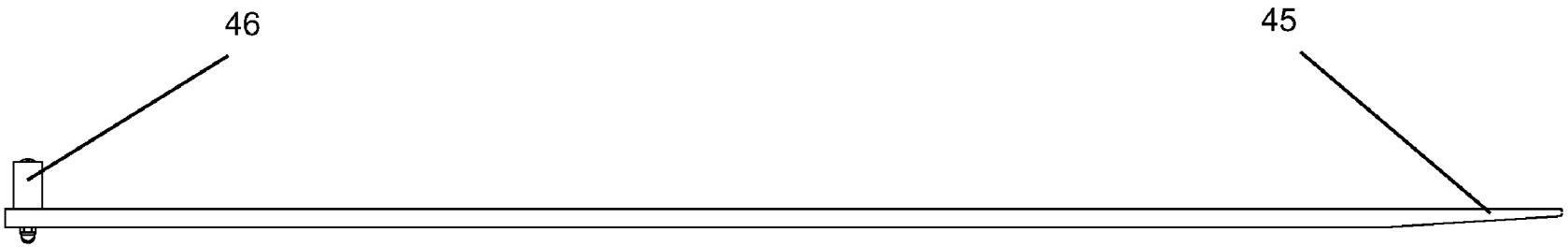
FIG. 2 is a side view of a bedside support in accordance with embodiments of the present invention.

Embodiments of the present invention may provide a tapered prong (45) as may be understood from FIG. 2 to perhaps ease sliding of a bedside support perhaps into a bed. A tapered prong (45) may be any kind of a projecting member which may have a single taper, double taper, or slendering configuration on a member of a bedside support. For example, a rigid extension prong may be tapered on one end to allow damage-free insertion and perhaps even sliding between a mattress set. The other end of a member or prong, and perhaps even the entire member in some embodiments, may be square or perhaps even rectangular and may provide rigid attachment to a rigid cross brace member. An extension prong may be of an appropriate thickness and width which may allow unnoticeable interruption and damage free operation to a mattress or other sleeping surface and yet may be thick enough to provide safe and proper bending movement and shear strength support during use. A width of an extension prong may be an appropriate size to provide cost effective material efficiency as well as may provide a width to provide safe and proper bending movement and shear strength support.

Figure 7:
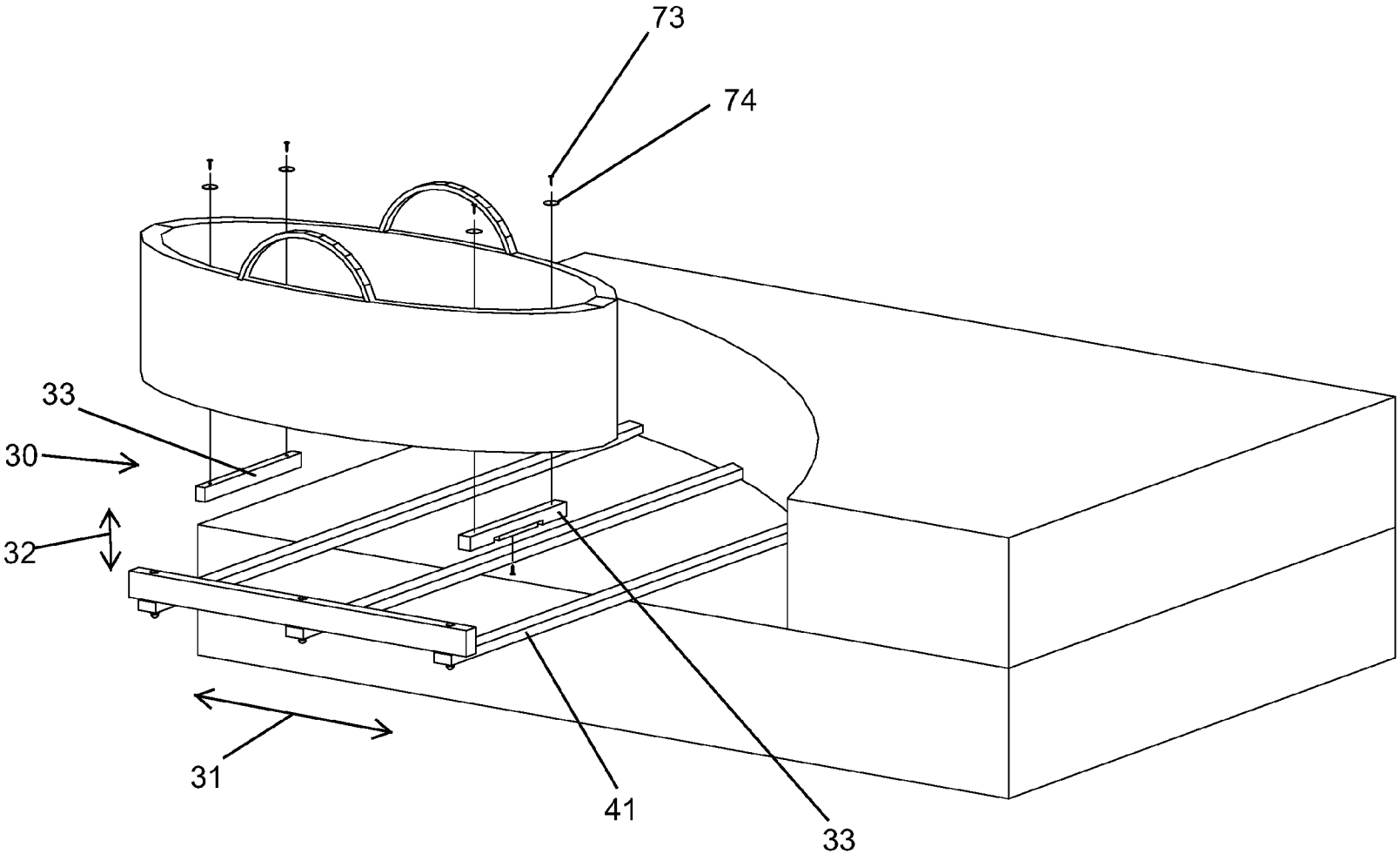
FIG. 7 shows an example of a sleeping receptacle securement attachment system to a bedside support in accordance with embodiments of the present invention.

In embodiments, a bedside support may include at least one secure hinge element (53). A secure hinge element (53) may be connected between a rigid extension prong and a rigid cross brace member. A hinge element may be configured to provide a foldable extension prong (43) to perhaps create a compact storage position (71) or even a substantially linear compact storage position as discussed herein. A secure hinge element (53) may even include a joint as between the end of an extension prong and a rigid cross brace member perhaps configured to allow the foldable extension prongs (43) to pivot with respect to the rigid cross brace member (46) as can be understood from FIGS. 1 and 7 showing an example of an open position (70) and a storage position (71), respectively.

A single-ended attachment hinge design may provide easy assembly methods to attach each extension prong with a rigid cross brace member, and may even allow separation gaps between the prongs to be easily set perhaps at near perpendicular angles. A secure hinge element may include holes and hardware between a prong and a cross brace member. Hardware may be tightened, loosened, or even removed during assembly, usage, disassembly, storage and the like. Hardware may be loosened to allow pivoting of the prongs or members to perhaps collapse all attachment angles down to near zero or may even be completely removed perhaps allowing all members to be easily disassembled and perhaps arranged in a linear fashion for easy and convenient sized storage as discussed herein. Each prong or member may have a predrilled attachment hole perhaps vertically through it, perhaps even at a non-tapered end, bored relative to an attachment hardware diameter. An attachment joint may provide a fixed end connection between the extension members or prongs and the rigid cross brace member.

A rigid cross brace member (46) may be a rectangular shaped length of rigid material. Its thickness may be an appropriate size to perhaps be thin enough for economical material efficiency yet may be thick enough perhaps for proper shear, movement, and even rocking movement rigidity strength as well as perhaps providing enough material to allow effective attachment hardware hole strength. A rigid cross brace member (46) may include a rigid cross brace front boundary board member as may be understood in FIG. 4 which may be an appropriate height to be small enough to be efficient to manufacture yet may be high enough provide securement of a sleeping receptacle perhaps by holding of the sleeping receptacles (20) tight to a mattress. A cross brace member may even be used as a handle to help a user pull or even push the bedside support. A cross brace member may be an appropriate length to support and hold most sleeping receptacles and may also provide for the appropriate spacing of the attached extending prongs perhaps to safely accommodate a sleeping receptacle or even other objects to rest on the bedside support. A cross brace member may have multiple predrilled attachment holes vertically through it which may be spaced at appropriate intervals perhaps with two outer holes being near its ends. A top side of a bore may be countersunk to allow attachment hardware bolt heads to be hidden below the exposed surface perhaps for aesthetical purposes and even for a flush interference free upper exposed surface.

As discussed above, attachment hardware may include bolts, screws (73), washers (74), and nuts such as but not limited to multiple standard threaded steel carriage bolts or even similar head style bolts, multiple matching sized steel washers and even hex or serrated flange nuts or the like. A diameter size of a bolt may be an appropriate width to accommodate sturdy and safe attachment of the extending prongs to a rigid cross brace member. Bolt lengths may be relatively close to the overall height of the assembled apparatus.

Embodiments of the present invention may provide systems for retractably supporting a co-sleeping bedside extension and uses thereof including but not limited to: establishing a bedside support; installingly inserting the bedside support into a bed; displacing a mattress apart from a mattress foundation with part of the bedside support while simultaneously supporting the bedside support's weight with the mattress; mattress supporting, laterally projecting part of the bedside support from the bed; securely placing a sleeping receptacle on part of the bedside support projecting from the bed; removing the sleeping receptacle from part of the bedside support projecting from the bed; facilely pushing against part of the bedside support into the bed; stowagingly sliding the bedside support between a mattress and a mattress foundation further displacing the mattress apart from the mattress foundation; and perhaps even substantially concealing the bedside support between a mattress and a mattress foundation within the bed.

For example, methods of use of a bedside support may provide easy installation of a bedside support between a mattress and mattress support of a bed such that when an end of the bedside support may be pushed into the bed, a mattress (12) may be displaced from a mattress foundation (13). The weight of a mattress may support a bedside support, perhaps even entirely all of the bedside support, while allowing part of the bedside support, perhaps even an extending platform sleeping receptacle receiving portion, to project out from the bed. A user may then securely place a sleeping receptacle (20) on part of the bedside support that may be projecting from the bed.

It may be desirable, in embodiments, to set or even place the bedside support at a secure extension length (17) from the bed so that the part projecting out from the bed may be properly supported by the mattress to allow safe use of the projecting part with a sleeping receptacle. A secure extension length (17) as shown in FIG. 3, may include but is not limited to: about 25% of the bedside support extending out of the bed; about 33% of the bedside support extending out of the bed, or the like. Of course, any amount may be used and the examples provided herein may vary. Specifically, in an example, a bedside support may be placed having about 33% of the bedside support extending out, a sleeping receptacle may be placed on the bedside support, and perhaps even, a bedside support may be pushed into the bed now having about 25% of the bedside support extending out which may secure the sleeping receptacle between the bedside support and the bed.

Secure placement of a sleeping receptacle may be provided simply by placing the sleeping receptacle on the bedside support. The rigid cross brace member (46) may prevent the sleeping receptacle from falling off of the bedside support, the planar member or even prongs may provide adequate support to hold the sleeping receptacle, and an end or even the side (21) of a mattress may provide secure holding of the sleeping receptacle (20) between the rigid cross brace member (46) and the bed as understood from FIG. 4. Therefore, in embodiments of the present invention, a sleeping receptacle may be securely embeddingly placed on the bedside support so that it may be firmly fixed in the surrounding bedside support and end of the bed.

Embodiments of the present invention may provide a bedside support (10) as a sturdy bedside support. Once a bedside support may be assembled, embodiments provide that there are no moving parts to the bedside support. When the bedside support may be pushed and even pulled from in between a mattress and mattress foundation, the entire bedside support may move without any moving parts therein. As such, the apparatus itself may stay completely still thus providing that the parts to the bedside support do not get worn out or deteriorated and the bedside support may last a very long time, if not forever, and may provide a heirloom to be passed down from one generation to another. It may be desirable to engrave a bedside support with a family name or the like as an heirloom for many generations to use.

Figure 5:
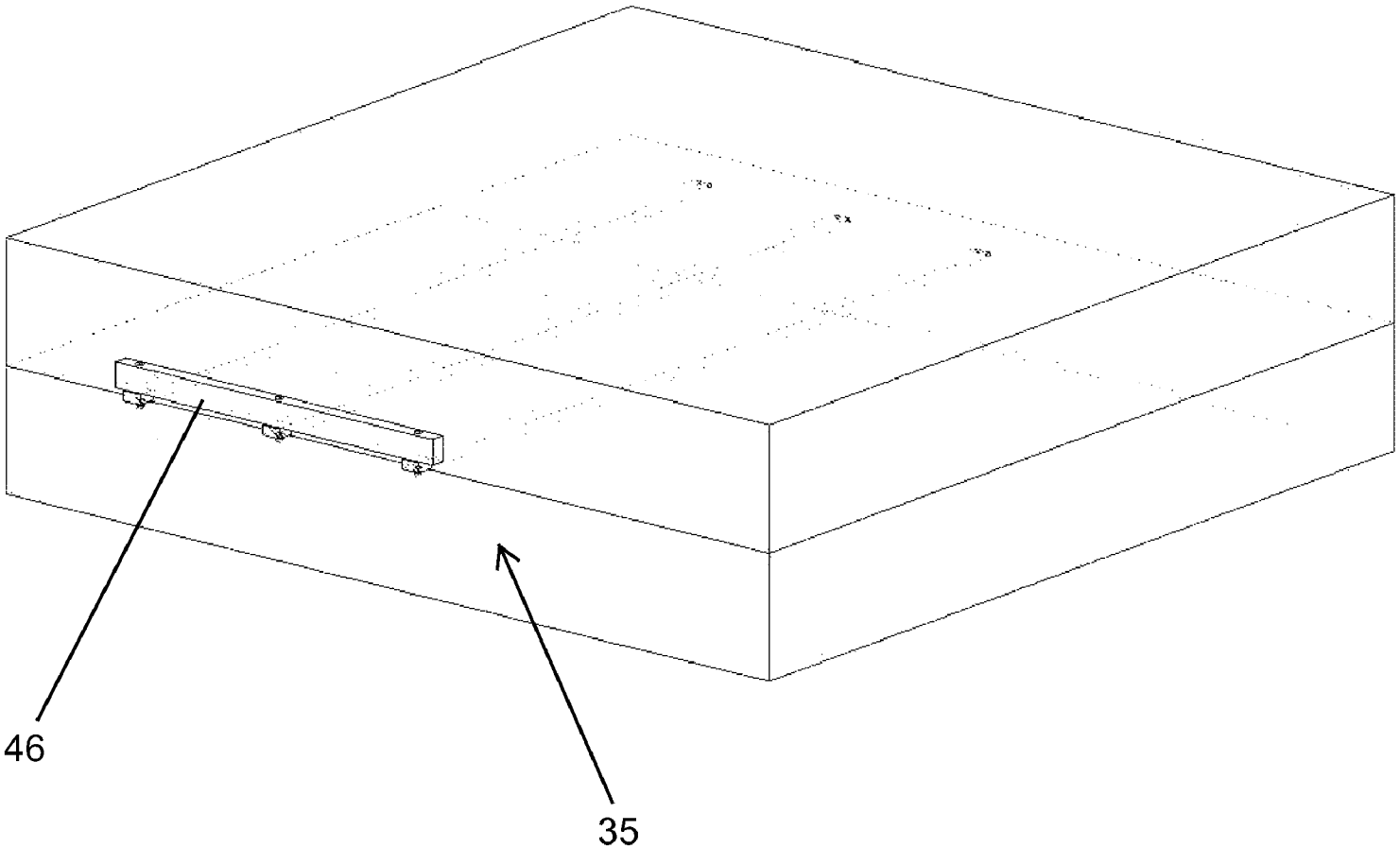
FIG. 5 shows an example of a bedside support as stored in a bed in accordance with embodiments of the present invention.
Figure 6:
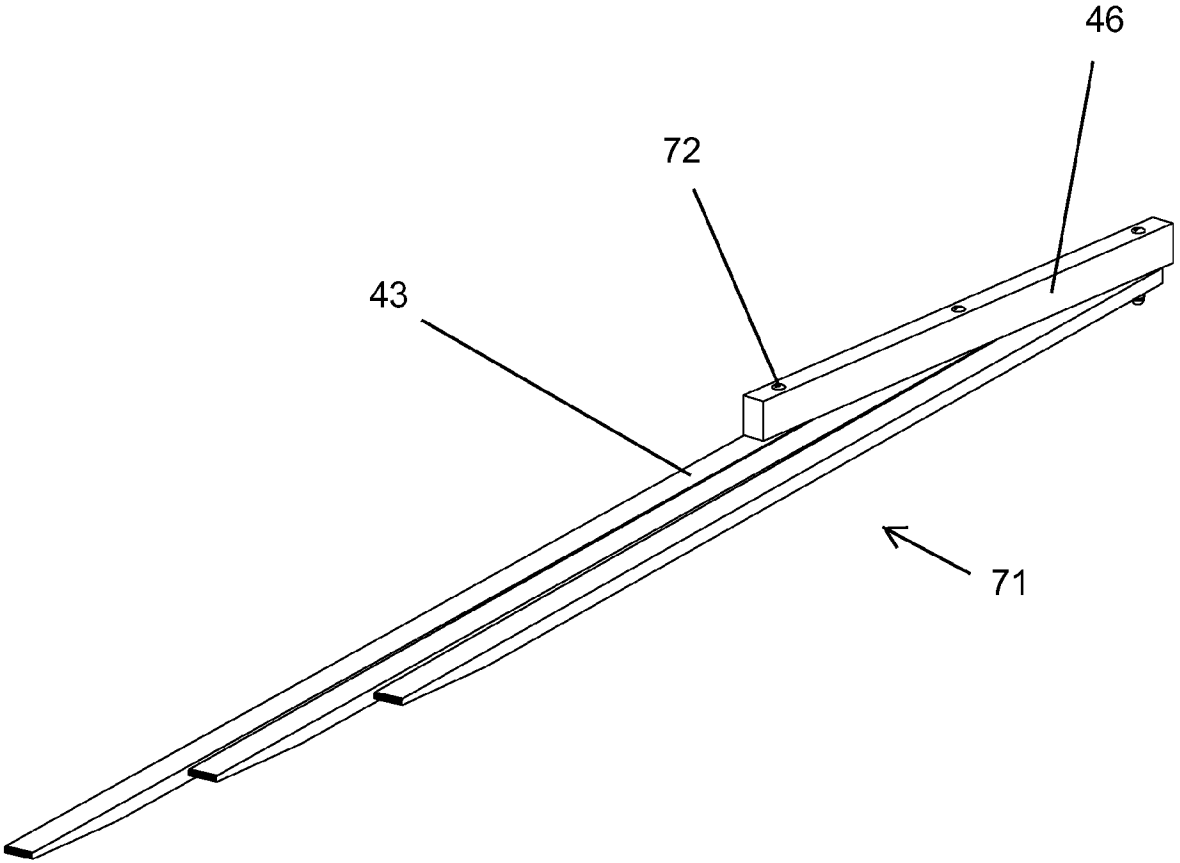
FIG. 6 shows an example of a collapsed bedside support in accordance with embodiments of the present invention.

Storage of a bedside support may include, in various embodiments, storage of the bedside support within a bed perhaps in an open position such as shown in the example in FIG. 5; folding up the bedside support into a compact storage position such as shown in the example in FIG. 6; and perhaps even disassembling and pulling apart the various parts of the bedside support and storing the unattached parts.

As mentioned above, a user may facilely push against part of a bedside support to move the bedside support into a bed. Facilely pushing may include pushing with little effort or difficulty and may provide easy pushing of the bedside support. In embodiments, a user may only need to one-step faciley push the bedside support to secure or perhaps even store a bedside support within the bed. Again, this may provide easy and perhaps hands-free use of the bedside support and may even allow a user to hold a sleeping receptacle, a baby, a pet, or any other article in one or both hands while still providing facile use of the bedside support. In some embodiments, pushing of the bedside support may include, but is not limited to: one-handed pushing against part of the bedside support into the bed; hip pushing against part of the bedside support into the bed; leaning against part of the bedside support into the bed; one movement pushing against part of the bedside support into the bed; knee pushing against part of the bedside support into the bed, and the like.

As a user may facilely push a bedside support into a bed, the bedside support may be stored perhaps by stowagingly sliding almost all of the bedside support between the mattress and mattress foundation so that it may be substantially concealed (35) within the bed as may be understood from FIG. 5. As the bedside support may be stowed within the bed, further displacement of the mattress apart from the mattress foundation may occur. Embodiments of the present invention may provide horizontally sliding of the bedside support into the bed and perhaps may even provide a bedside support which may be engulfed within the bed so that a bedside support may be fully retracted between a mattress and mattress foundation. As such, a bedside support may be configured to fit entirely, or perhaps all of the bedside support may be moved, in between a mattress and a mattress foundation perhaps with the exception that an end of the bedside support may remain exposed. As understood in FIG. 5, a rigid cross brace member (46) of a bedside support may be placed right next to a bedside so that the bedside support may be substantially out of the way. In embodiments, it may be desirable to cover the end of the bedside support perhaps with a cover, sheet, fitted sheet (not shown but may be understood from FIG. 5) or the like so as to provide a fully hidden bedside support within a bed. For re-use, a user may uncover the bedside support, pull the bedside support out from in between the mattress and mattress foundation perhaps by pulling or even grabbing the end of the bedside support such as on the rigid cross brace member, placing the bedside support at an appropriate use distance from the bed, and may even reuse the bedside support by placing a sleeping receptacle on the bedside support, and the like.

As mentioned above, another way to store a bedside support may be to place or even collapse the bedside support in a compact storage position (71) as shown in the example in FIG. 6. For example, the rigid extension prongs may be moved, folded or perhaps even hingedly moved against each other and perhaps even along a cross brace member (46) to provide a substantially linear compact storage position. The compact storage position (71) may be secured with a securement element (72) perhaps by tightening hardware on the bedside support or may even be secured with a flexible closure, non-flexible closure, a flexible band, a non-flexible band, a band, an elastic band, a rubber band, a lock, a cover, or the like. The collapsed bedside support may then be easily stored under a bed, in a closet, or the like due to its linear storage position. When a user may desire to use the bedside support again, they may open the collapsed bedside support and use it as herein discussed.

In embodiments, the present invention may provide securing a sleeping receptacle to a bedside support. For example, a sleeping receptacle may be rested, placed, attached, fastened, locked, anchored or perhaps even secured with a sleeping receptacle securement attachment system (30) or the like as shown in an example in FIG. 7. A sleeping receptacle securement attachment system may be attached to a sleeping receptacle and may even be attached at the bottom of a sleeping receptacle perhaps with a securement element such as with a screw (73), washer (74) or other attachment elements. A sleeping receptacle securement system may be configured to prevent horizontal movement (31) of a sleeping receptacle on a bedside support. For example, a sleeping receptacle slide stop (33) may be provided on a sleeping receptacle securement system so that when placed on a bedside support, the slide stop may fit in between, next to, or even securely over at least one of the rigid extension prongs so that the sleeping receptacle cannot be moved in a horizontal direction on the bedside support. In embodiments, a sleeping receptacle slide stop (33) may include two end block securement elements.

Figure 8:
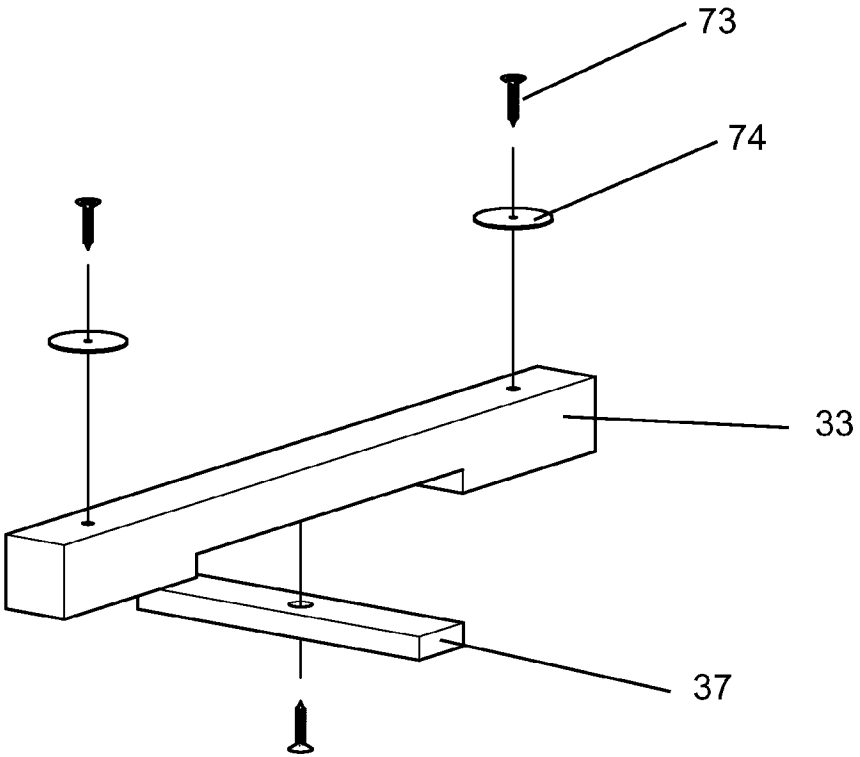
FIG. 8 shows an example of a sleeping receptacle slide stop with an optional safety latch in accordance with embodiments of the present invention.

Alternatively or perhaps even in addition to the prevention of horizontal movement, embodiments of the present invention may provide a sleeping receptacle securement system which may be configured to prevent vertical movement (32) of a sleeping receptacle on a bedside support. This may secure a sleeping receptacle on the bedside support and as such, a sleeping receptacle may not be removed until the sleeping receptacle securement system is removed, unlocked, unlatched, or otherwise disengaged. For example, a sleeping receptacle securement attachment system may include a safety latch (37) as shown in the example in FIG. 8 wherein a latch may be engaged under the bedside support so that the sleeping receptacle cannot be removed. To allow easy use of the sleeping receptacle securement system, a spacer may be provided between perhaps two sleeping receptacle slide stops. The spacer may allow easy placement of the slide stops onto the sleeping receptacle.

Figure 9:
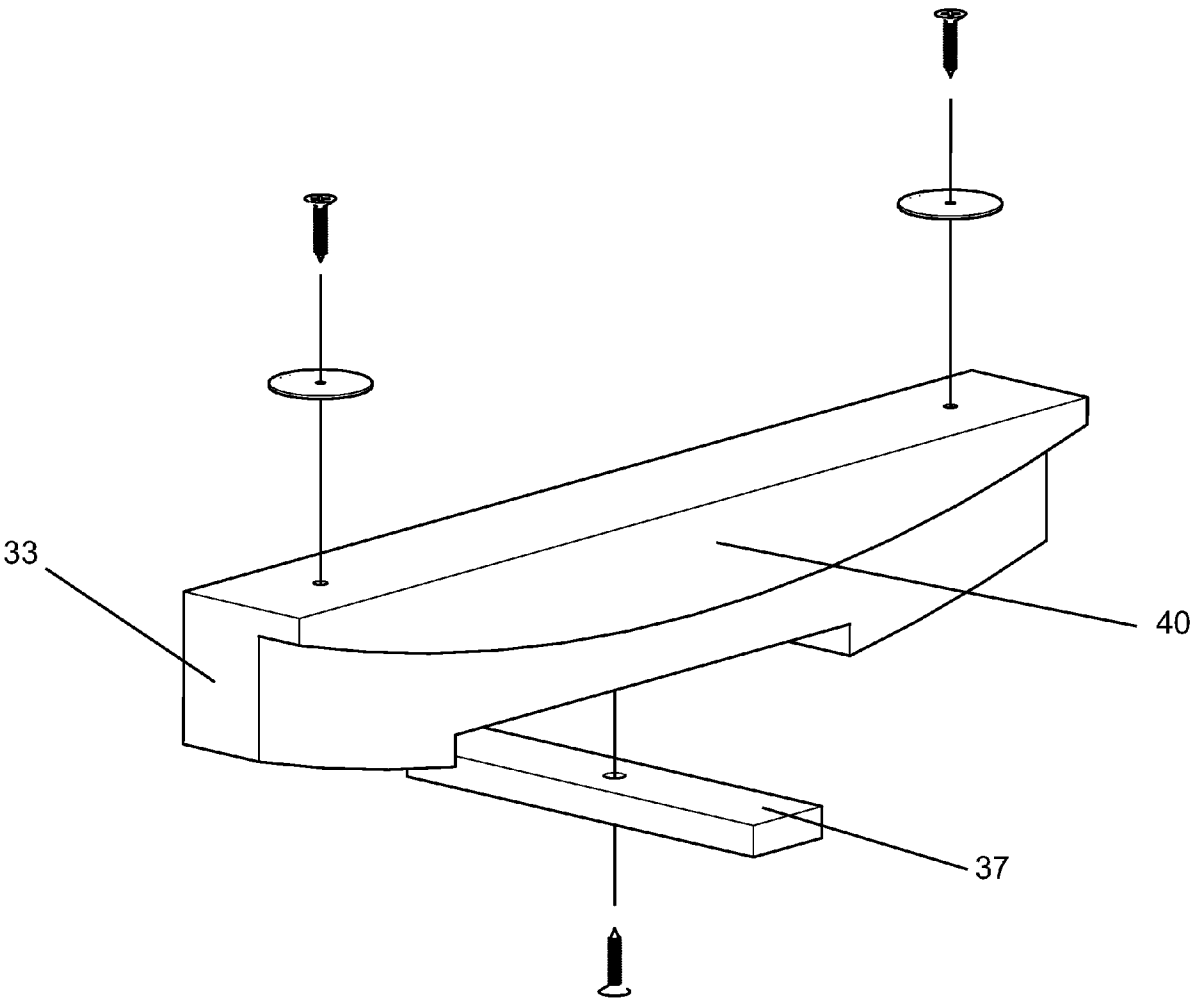
FIG. 9 shows an example of a secure rocking element with an optional sleeping receptacle slide stop and optional safety latch in accordance with embodiments of the present invention.

In embodiments, the present invention may provide a secure rocking element (40) which may be attached to a sleeping receptacle and may provide the ability to rock a sleeping receptacle while it is securely placed on a bedside support or perhaps even while it may be placed on a flat surface. A secure rocking element (40) may be included in a sleeping receptacle securement attachment system and may even be in association with a slide stop (33), safety latch (37), combinations thereof, or the like. For example, a secure rocking element (40) may be a curved rocker element as shown in FIG. 9.

For each of the embodiments discussed herein, it may be desirable to provide a smaller bedside support for children's use with their dolls, toys, and the like. In alternative embodiments, a bedside support may be supported by at least one leg, perhaps even a spring hinge support leg or the like to provide additional support. A storage area may be provided on or even in the bedside support, perhaps on the extending platform sleeping receptacle receiving portion, to provide placement of items and the like.

As can be easily understood from the foregoing, the basic concepts of the present invention may be embodied in a variety of ways. It involves both bedside supporting techniques as well as devices to accomplish the appropriate bedside support. In this application, the bedside supporting techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "displacer" should be understood to encompass disclosure of the act of "displacing"—whether explicitly discussed or not—and, conversely, were there effectively disclosure of the act of "displacing", such a disclosure should be understood to encompass disclosure of a "displacer" and even a "means for displacing." Such changes and alternative terms are to be understood to be explicitly included in the description. Further, each such means (whether explicitly so described or not) should be understood as encompassing all elements that can perform the given function, and all descriptions of elements that perform a described function should be understood as a non-limiting example of means for performing that function.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the bedside support devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) an apparatus for performing the methods described herein comprising means for performing the steps, xii) the various combinations and permutations of each of the elements disclosed, xiii) each potentially dependent claim or concept as a dependency on each and every one of the independent claims or concepts presented, and xiv) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim* v. *Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 25 (if such were to exist) if desired and still fall within the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A method for retractably supporting a co-sleeping bedside extension comprising the steps of:

establishing a substantially planar bedside support;

installingly inserting said substantially planar bedside support into a bed;

displacing a mattress apart from a mattress foundation with part of said substantially planar bedside support while simultaneously supporting said substantially planar bedside support's weight with said mattress;

mattress supporting, lateral projectingly suspending part of said substantially planar bedside support from said bed;

facilely securely placing a portable, repositionably useable sleeping receptacle on said part of said substantially planar bedside support projecting from said bed;

facilely removing said portable, repositionably useable sleeping receptacle from said part of said substantially planar bedside support projecting from said bed;

facilely one-step pushing against part of said substantially planar bedside support into said bed;

stowagingly horizontally sliding said substantially planar bedside support between said mattress and said mattress foundation further displacing said mattress apart from said mattress foundation;

substantially concealingly engulfing almost all of said substantially planar bedside support between said mattress and said mattress foundation within said bed; and covering an end of said substantially planar bedside support.

2. A method for retractably supporting a co-sleeping bedside extension comprising the steps of:

establishing a bedside support;

installingly inserting said bedside support into a bed;

displacing a mattress apart from a mattress foundation with part of said bedside support while simultaneously supporting said bedside support's weight with said mattress;

mattress supporting laterally projecting part of said bedside support from said bed;

facilely securely placing a portable, repositionably useable sleeping receptacle on said part of said bedside support projecting from said bed;

facilely removing said portable, repositionably useable sleeping receptacle from said part of said bedside support projecting from said bed;

facilely one-step pushing against part of said bedside support into said bed;

stowagingly sliding said bedside support between said mattress and said mattress foundation further displacing said mattress apart from said mattress foundation; and substantially concealing almost all of said bedside support between said mattress and said mattress foundation within said bed.

3. A method for retractably supporting a co-sleeping bedside extension according to claim 2 wherein said step of facilely securely placing a portable, repositionably usable sleeping receptacle on said part of said bedside support projecting from said bed comprises the step of providing a receptacle selected from a group consisting of a basket, baby bed, pet bed, Moses basket, baby basket, pet basket, doll bed, doll basket, and newborn basket.

4. A method for retractably supporting a co-sleeping bedside extension according to claim 2 wherein said step of facilely securely placing said portable, repositionably useable sleeping receptacle on said part of said bedside support projecting from said bed comprises the step of providing a sleeping receptacle securement attachment system.

5. A method for retractably supporting a co-sleeping bedside extension according to claim 4 and further comprising the step of preventing horizontal movement of said sleeping receptacle on said bedside support with said sleeping receptacle securement attachment system.

6. A method for retractably supporting a co-sleeping bedside extension according to claim 5 wherein said step of preventing horizontal movement of said sleeping receptacle on said bedside support with said sleeping receptacle securement attachment system comprises the step of providing a sleeping receptacle slide stop.

7. A method for retractably supporting a co-sleeping bedside extension according to claim 4 and further comprising the step of preventing vertical movement of said sleeping receptacle on said bedside support with said sleeping receptacle securement attachment system.

8. A method for retractably supporting a co-sleeping bedside extension according to claim 7 wherein said step of preventing vertical movement of said sleeping receptacle on said bedside support with said sleeping receptacle securement attachment system comprises the step of safety latching said sleeping receptacle securement attachment system to said bedside support.

9. A method for retractably supporting a co-sleeping bedside extension according to claim 2 and further comprising the step of rocking said sleeping receptacle while securely placed on part of said bedside support.

10. A method for retractably supporting a co-sleeping bedside extension according to claim 9 wherein said step of rocking said sleeping receptacle while securely placed on part of said bedside support comprises the step of rocking said sleeping receptacle with a curved rocker attachment.

11. A method for retractably supporting a co-sleeping bedside extension according to claim 2 wherein said step of facilely pushing against part of said bedside support into said bed selected from a group consisting of one-step pushing against part of said bedside support; one-handed pushing against part of said bedside support into said bed, hip pushing against part of said bedside support into said bed, leaning against part of said bedside support into said bed, one movement pushing against part of said bedside support into said bed, and knee pushing against part of said bedside support into said bed.

12. A method for retractably supporting a co-sleeping bedside extension according to claim 2 wherein said step of substantially concealing almost all of said bedside support between said mattress and said mattress foundation within said bed comprises the step of placing all of said bedside support in between said mattress and said mattress foundation except for an end of said bedside support.

13. A method for retractably supporting a co-sleeping bedside extension according to claim 2 and further comprising the step of contacting said bedside support only between a bottom of said mattress and a top of said mattress foundation.

14. A method for retractably supporting a co-sleeping bedside extension according to claim 2 wherein said step of establishing said bedside support comprises the step of establishing a floating bedside support.

15. A method for retractably supporting a co-sleeping bedside extension according to claim 2 wherein said step of mattress supporting laterally projecting part of said bedside support from said bed comprises the step of placing said bedside support at a secure extension length from said bed.

16. A method for retractably supporting a co-sleeping bedside extension according to claim 15 wherein said secure extension length is selected from a group consisting of: about 25% of said bedside support extending out of said bed; and about 33% of said bedside support extending out of said bed.

17. A method for retractably supporting a co-sleeping bedside extension according to claim 2 and further comprising the step of collapsing said bedside support.

18. A method for retractably supporting a co-sleeping bedside extension according to claim 17 wherein said step of collapsing said bedside support comprises the step of hingedly moving parts of said bedside support into a substantially linear collapsed position.

19. A method for retractably supporting a co-sleeping bedside extension according to claim 2 and further comprising the step of single-handed operating said portable, repositionable sleeping receptacle during said steps of facilely securely placing said portable, repositionably useable sleeping receptacle on said part of said bedside support projecting from said bed and facilely removing said portable, repositionably useable sleeping receptacle from said part of said bedside support projecting from said bed.

20. A method for retractably supporting a co-sleeping bedside extension according to claim 2 wherein said step of facilely securely placing said portable, repositionably useable sleeping receptacle on said part of said bedside support projecting from said bed comprises the step of one-step facilely securely placing said portable, repositionably useable sleeping receptacle on said part of said bedside support projecting from said bed; and wherein said step of facilely removing said portable, repositionably useable sleeping receptacle from said part of said bedside support projecting from said bed comprises the step of one-step facilely removing said portable, repositionably useable sleeping receptacle from said part of said bedside support projecting from said bed.

* * * * *